US010465449B2

(12) United States Patent
Saini

(10) Patent No.: US 10,465,449 B2
(45) Date of Patent: Nov. 5, 2019

(54) POLYCRYSTALLINE DIAMOND COMPACT WITH FIBER-REINFORCED SUBSTRATE

(71) Applicant: Halliburton Energy Services, Inc., Houston, TX (US)

(72) Inventor: Gagan Saini, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 138 days.

(21) Appl. No.: 15/580,728

(22) PCT Filed: Jul. 8, 2015

(86) PCT No.: PCT/US2015/039564

§ 371 (c)(1),
(2) Date: Dec. 8, 2017

(87) PCT Pub. No.: WO2017/007471

PCT Pub. Date: Jan. 12, 2017

(65) Prior Publication Data

US 2018/0148979 A1 May 31, 2018

(51) Int. Cl.

| | |
|---|---|
| ***E21B 10/573*** | (2006.01) |
| ***B22F 7/06*** | (2006.01) |
| ***C22C 26/00*** | (2006.01) |
| ***C22C 47/14*** | (2006.01) |

(Continued)

(52) U.S. Cl.

CPC ..... *E21B 10/5735* (2013.01); *B22F 5/00* (2013.01); *B22F 7/06* (2013.01); *C22C 26/00* (2013.01); *C22C 47/14* (2013.01); *E21B 10/573* (2013.01); *B22F 2005/001* (2013.01); *B22F 2202/05* (2013.01); *B22F 2302/406* (2013.01);

(Continued)

(58) Field of Classification Search

CPC .. E21B 10/16; E21B 10/573; E21B 2010/564; B22F 1/0025; B22F 1/004; B22F 1/0007; B22F 1/0055; B22F 2010/0029; B22F 2010/0033; B22F 2005/001; C22C 26/00

See application file for complete search history.

(56) References Cited

U.S. PATENT DOCUMENTS 5,304,342 A * 4/1994 Hall, Jr. ..... B01J 3/062 419/11
6,454,027 B1 * 9/2002 Fang ..... C09K 3/1418 175/374

(Continued)

FOREIGN PATENT DOCUMENTS

CN 102700191 10/2012
CN 103567504 2/2014

(Continued)

OTHER PUBLICATIONS

International Search Report and Written Opinion for PCT Patent Application No. PCT/US2015/039564, dated Mar. 16, 2016; 17 pages.

(Continued)

*Primary Examiner* — Kenneth L Thompson
(74) *Attorney, Agent, or Firm* — Baker Botts L.L.P.

(57) ABSTRACT

The present disclosure relates to a polycrystalline diamond compact (PDC) with a fiber-reinforces substrate. The disclosure further relates to method of forming such a PDC.

20 Claims, 3 Drawing Sheets

(51) Int. Cl.
*B22F 5/00* (2006.01)
*E21B 10/54* (2006.01)

(52) U.S. Cl.
CPC ..... *B22F 2998/10* (2013.01); *B22F 2999/00* (2013.01); *C22C 2202/02* (2013.01); *E21B 10/54* (2013.01)

(56) References Cited

U.S. PATENT DOCUMENTS

| | | | | |
|---|---|---|---|---|
| 7,695,542 | B2 * | 4/2010 | Drivdahl | E21B 10/48 75/229 |
| 8,172,914 | B2 | 5/2012 | Mirchandani et al. | |
| 8,261,858 | B1 | 9/2012 | Atkins et al. | |
| 8,689,909 | B2 | 4/2014 | Digiovanni | |
| 9,157,283 | B2 * | 10/2015 | Patel | E21B 10/46 |
| 2005/0158200 | A1 | 7/2005 | Pope et al. | |
| 2006/0060392 | A1 | 3/2006 | Eyre | |
| 2007/0284152 | A1 | 12/2007 | Eyre et al. | |
| 2008/0179104 | A1 | 7/2008 | Zhang et al. | |
| 2008/0210473 | A1 * | 9/2008 | Zhang | B22F 1/0025 175/426 |
| 2011/0088954 | A1 * | 4/2011 | DiGiovanni | C04B 35/52 175/336 |
| 2011/0266068 | A1 | 11/2011 | Eason et al. | |
| 2012/0012403 | A1 * | 1/2012 | de Rochemont | C23C 24/085 175/434 |
| 2012/0103697 | A1 | 5/2012 | Digiovanni | |
| 2012/0151848 | A1 * | 6/2012 | Suryavanshi | B22F 5/00 51/309 |
| 2013/0168157 | A1 * | 7/2013 | Belnap | B24D 3/04 175/428 |
| 2015/0089882 | A1 * | 4/2015 | Pearce | B24D 3/06 51/309 |
| 2016/0265282 | A1 | 9/2016 | Olsen | |
| 2018/0214952 | A1 * | 8/2018 | Saini | B22F 3/14 |

FOREIGN PATENT DOCUMENTS

| | | |
|---|---|---|
| CN | 103880460 | 6/2014 |
| CN | 104144876 | 11/2014 |
| WO | 2013/101858 | 7/2013 |
| WO | 2013185511 | 12/2013 |

OTHER PUBLICATIONS

International Preliminary Report on Patentability for PCT Patent Application No. PCT/US2015/039564, dated Jan. 18, 2018; 11 pages.
Office Action for Chinese Patent Application No. 201580080741.8, dated Jan. 22, 2019, no English translation; 9 pages.

* cited by examiner

POLYCRYSTALLINE DIAMOND COMPACT WITH FIBER-REINFORCED SUBSTRATE

RELATED APPLICATIONS

This application is a U.S. National Stage Application of International Application No. PCT/US2015/039564 filed Jul. 8, 2015, which designates the United States, and is incorporated herein by reference in its entirety.

TECHNICAL FIELD

The current disclosure relates to a polycrystalline diamond compact (PDC), such as a cutter in an earth-boring drill bit.

BACKGROUND

Components of various industrial devices are often subjected to extreme conditions, such as high-temperatures and high-impact contact with hard and/or abrasive surfaces. For example, extreme temperatures and pressures are commonly encountered during drilling for oil extraction or mining purposes. Diamond, with its unsurpassed mechanical properties, can be the most effective material when properly used in a cutting element or abrasion-resistant contact element for use in drilling. Diamond is exceptionally hard, conducts heat away from the point of contact with the abrasive surface, and may provide other benefits in such conditions.

Diamond in a polycrystalline form has added toughness as compared to single-crystal diamond due to the random distribution of the diamond crystals, which avoids the particular planes of cleavage found in single-crystal diamond. Therefore, polycrystalline diamond is frequently the preferred form of diamond in many drilling applications. A drill bit cutting element that utilizes polycrystalline diamond is commonly referred to as a polycrystalline diamond cutter or compact (PDC). Accordingly, a drill bit incorporating PDC may be referred to as a PDC bit.

PDCs can be manufactured in a cubic, belt, or other press by subjecting small grains of diamond and other starting materials to ultrahigh pressure and temperature conditions. One PDC manufacturing process involves forming a polycrystalline diamond table directly onto a substrate, such as a tungsten carbide substrate. The process involves placing a substrate, along with loose diamond grains mixed with a sintering aid, into a container of a press, and subjecting the contents of the press to a high-temperature high-pressure (HTHP) press cycle. The high temperature and pressure cause the small diamond grains to form into an integral polycrystalline diamond table intimately bonded to the substrate, with cobalt in tungsten carbide substrate acting as a catalyst during liquid-phase sintering, to create diamond-diamond bonds from precipitation of carbon from a solid solution of cobalt-carbon. A polycrystalline diamond table thus formed may then be leached to remove the sintering aid from all or part of the polycrystalline diamond. The resulting leached PDC is more thermally stable than similar, non-leached PDC.

Leaching out large portions of the sintering aid results in a thermally stable polycrystalline diamond (TSP) table. At a certain temperature, typically at least 750° C. at normal atmospheric pressure, the TSP will not crack or graphitize, but non-leached PDC will crack or graphitize under similar conditions. TSP may be reattached to a new substrate (the original one on which the polycrystalline diamond was formed often being removed prior to or destroyed in the leaching process) to form a PDC.

BRIEF DESCRIPTION OF THE DRAWINGS

A more complete understanding of the present embodiments and advantages thereof may be acquired by referring to the following description taken in conjunction with the accompanying drawings, which show particular embodiments of the current disclosure, in which like numbers refer to similar components, and in which.

DETAILED DESCRIPTION

The present disclosure relates to a PDC with a fiber-reinforced substrate. The PDC may be a non-leached PDC, a PDC in which the polycrystalline diamond is leached a depth from a surface, or a PDC formed from TSP. The substrate may be the original substrate on which the polycrystalline diamond was formed, or it may be a subsequent substrate to which the polycrystalline diamond is attached, for example after leaching. Regardless of what leaching, if any, is present or whether the substrate is the original or subsequent substrate, the substrate may be reinforced with fibers to improve bonding between the substrate and the polycrystalline diamond, to render the substrate more resistance to cracking or crack propagation during use of the PDC, or both. The greater resistance to cracking or crack propagation may manifest as higher values of transverse rupture strength (TRS) or impact resistance.

Figure 1:
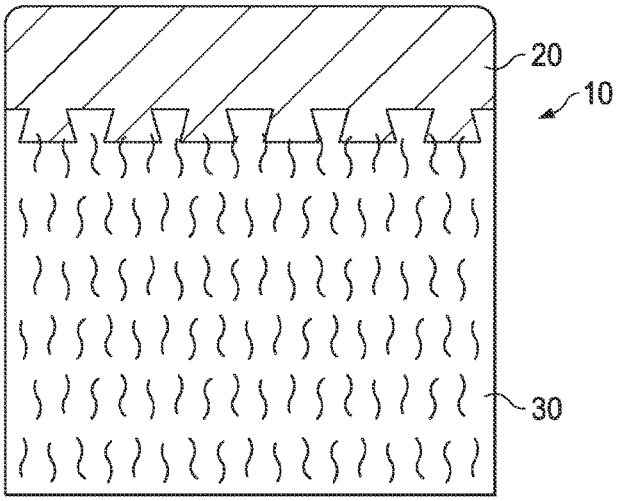
FIG. 1 is a not-to-scale cross-sectional schematic side view of a PDC with a uniform fiber-reinforced substrate.
Figure 2:
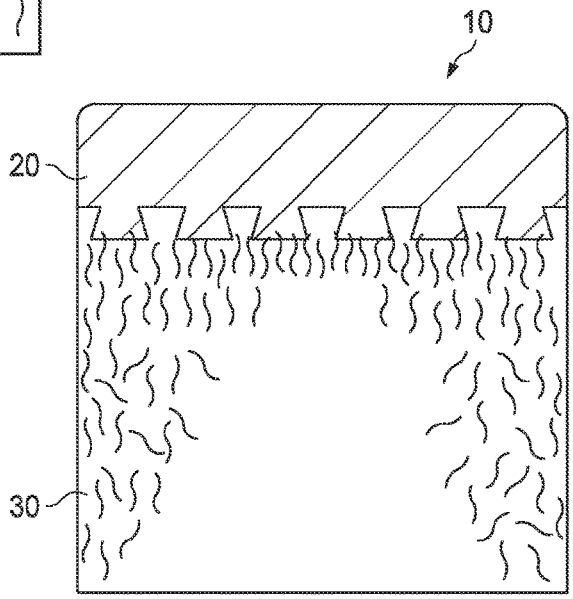
FIG. 2 is a not-to-scale cross-sectional schematic side view of a PDC with a fiber-reinforced substrate with fibers localized in portions of the substrate.
Figure 3:
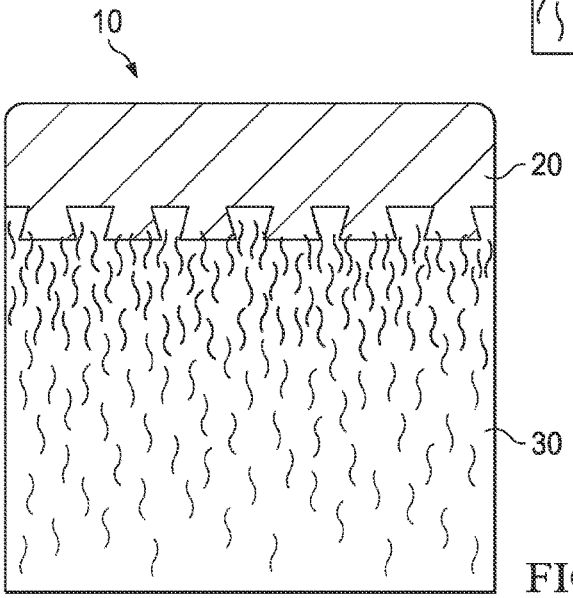
FIG. 3 is a not-to-scale cross-sectional schematic side view of a PDC with a fiber-reinforced substrate containing fiber gradients.

Referring to FIGS. 1, 2 and 3 PDC 10 includes polycrystalline diamond table 20 bonded to fiber-reinforced substrate 30.

Polycrystalline diamond table 20 may be non-leached. However, in order to make it more thermally stable, at least a part of the catalyst/sintering aid (typically a material containing a Group VIII metal or metal alloy, such as cobalt (Co) or a Co alloy) used to form polycrystalline diamond table 20 may be leached from it. The catalyst may be leached to a depth from the working surface or a side surface of polycrystalline diamond table 20. For instance, at least 85% of the catalyst may be leached from polycrystalline diamond table 20 to a depth of at least 10 μm, 50 μm, 100 μm, or 500 μm, or 750 μm from the working surface, the side surface, or both.

If the entire polycrystalline diamond table 20 or substantially all of it has been leached, the table may then be a TSP table. The TSP table may also lack a substrate, which may have been present during formation of the polycrystalline diamond used to create the TSP. The substrate may have been mechanically removed, destroyed by the leaching process, or both. A TSP table may include some residual sintering aid, such as no more than 70% of the sintering aid originally found in the PCD table or no more than 1% sintering aid by weight or volume. The TSP table may be thermally stable at temperatures of at least 750° C., at least 1050° C. or even at least 1200° C. at atmospheric pressure. The TSP table may otherwise also be thermally stable at temperatures and pressures at which graphitization of diamond in the presence of sintering aid is expected to occur.

Substrate 30, in addition to fibers, may contain a binder and a cemented material.

In FIG. 1, fibers are uniformly distributed throughout fiber-reinforced substrate 30. This configuration may be easy to manufacture and may provide resistance to cracking and crack propagation regardless of the source of any force applied to substrate 30.

In FIG. 2, fibers are localized near the interface between polycrystalline diamond table 20 and fiber-reinforced substrate also at the outer side surface of fiber-reinforced substrate 30. These locations are examples of where the fibers provide the most benefit. Fibers need not be present in both locations depicted. For instance, fibers may only be localized near the interface. Fibers at the interface are able to bond to both polycrystalline diamond table 20 and substrate 30, improving bonding between these two components. For instance, tungsten fibers may improve bonding by forming tungsten carbide at the points of contact with polycrystalline diamond table 20. Fibers near the interface are also able to prevent or hinder propagation of cracks in substrate 30 in the area, which may be more prone to cracking than other areas of substrate 30 due to different rates of thermal expansion of polycrystalline diamond table 20 and substrate 30 as the PDC heats or cools and due to stresses applied to polycrystalline diamond table 20 and transferred to substrate 30. Fibers along the outer side surface of fiber-reinforced substrate 30 may prevent or hinder propagation of cracks in this area resulting from lateral stresses on PDC 10 during actual use in drilling.

Fibers may be deposited in areas of substrate 30 other than those depicted in FIG. 2 in order to reinforce substrate 30 and prevent or hinder propagation of cracks resulting from stresses during PDC use.

Fibers deposited in certain areas of substrate 30 may be uniformly distributed within the areas, or they may be non-uniformly distributed. For example they may form a gradient.

In FIG. 3, fibers are located throughout substrate 30, but they form a gradient decreasing in concentration with distance from polycrystalline diamond table 20. This embodiment may be easier to manufacture than embodiments with fibers localized in specific areas, such as in FIG. 2, while still providing increased bonding and crack resistance near the interface of substrate 30 and polycrystalline diamond table 20.

The fiber locations in FIGS. 1, 2 and 3 merely illustrate some possibilities. Substrate 30 may contain fibers in any area and the fibers may be uniformly distributed, in gradients, in other controlled concentration profiles, or in random concentrations. The specific locations and concentration/distribution may be determined based on any of a number of factors including ease or difficulty of manufacturing, fiber cost, the known or projected stress locations during PDC use, the know or projected failure points of the bond between polycrystalline diamond table 20 and substrate 30, and desired life of the PDC 10.

In addition, the fibers may have any of a number of orientations. A random orientation, as may be seen along the sides of substrate 30 in FIG. 2, may best prevent or hinder propagation of cracks. A linear orientation, as may be seen near the interface of polycrystalline diamond table 20 and substrate 30 in FIGS. 1, 2 and 3, may facilitate improved bonding of polycrystalline diamond table 20 to substrate 30. Orientation may be determined based on any of a number of factors including ease or difficulty of manufacturing.

The fibers may have an average diameter of 100 μm or less, 1 μm or less, 0.5 μm or less, 0.1 μm or less, 0.05 μm or less, or 0.01 μm or less. Thus, the fibers may be nanofibers. The fibers have an average aspect ratio of at least a critical aspect ratio, $A_c$, defined as:

$$A_c=\sigma_f/(2T_c) \quad \text{(I)},$$

wherein $\sigma_f$ is the ultimate tensile strength of the fibers and $T_c$ is the shear bond strength between the fiber and the binder.

Fibers may be in the shape of whiskers, rods, wires, dog bones, ribbons, discs, wafers, flakes, or rings. They may be unbranched or branched.

Fibers may be formed from any metal or any other element, alloy, or compound that does not melt at the melting point of the binder used to form substrate 30. Fibers may be primarily formed from or include tungsten (W) molybdenum (Mo), titanium (Ti), chromium (Cr), manganese (Mn), yttrium (Yt), zirconium (Zr), niobium (Nb), Hafnium (Hf), Tantalum (Ta), nickel (Ni), carbon (C), any refractory ceramic, or any combinations, mixtures, or alloys thereof. These materials increase bonding by forming carbides at the points of contact with polycrystalline diamond table 20. The fiber composition may be selected based on other properties conferred, such as the ability to form a carbide bond with diamond, or based on the other materials in fiber-reinforced substrate 30. Typically the fibers may be selected to have a melting point higher than the production temperature used to form fiber-reinforced substrate 30 or to attach it to polycrystalline diamond table 30. This melting point is typically also higher than the melting point of the binder used to form substrate 30. In general, the fiber melting point may be selected to avoid melting or substantial absorption of the fibers, so they remain distinguishable within substrate 30.

Fibers in fiber-reinforced substrate 30 may include more than one size of fiber, more than one length of fiber, more than one shape of fiber, or fibers of more than one composition. Mixtures of sized and compositions maybe determined by a number of factors including cost, ease or difficulty of manufacturing, properties conferred by each fiber size, length or composition, and any interactions between the different fibers.

Substrate 30 may include a cemented material, such as cemented materials including carbide, tungsten (W), tungsten carbide (WC or $W_2C$), synthetic diamond, natural diamond, chromium (Cr), iron (Fe), nickel (Ni), (Cu), manganese (Mn), phosphorus (P), oxygen (O), zinc (Zn), tin (Sn), cadmium (Cd), lead (Pb), bismuth (Bi), or tellurium (Te), and any combinations, mixtures, or alloys thereof.

Suitable binders for substrate 30 include a metal or metal alloy binder, such as a Group VIII metal or metal alloy. Specifically, suitable binders include copper (Cu), nickel (Ni), cobalt (Co), iron (Fe), aluminum (Al) molybdenum (Mo), titanium (Ti), chromium (Cr), manganese (Mn), tin (Sn), zinc (Zn), lead (Pb), silicon (Si), tungsten (W), boron (B), phosphorus (P), gold (Au), silver (Ag), palladium (Pd), indium (In), and any combinations, mixtures, or alloys thereof. The binder may be the same as or different from the sintering aid used in polycrystalline diamond formation. The fiber and binder typically have a different composition as do the fiber and cemented material. One example binder is a Cu—Mn—Ni alloy.

Although as shown in FIGS. 1, 2 and 3, PDC 10 is in a generally cylindrical shape with a flat surface, it may be formed in any shape suitable for its ultimate use, such as a conical shape, a variation of a cylindrical shape, or even with angles. Additionally, the surface of PDC 10 may be concave, convex, or irregular. Furthermore, although the interface between polycrystalline diamond table 20 and substrate 30 is shown as interlocking in FIGS. 1, 2 and 3, it may be planar, with other regular raised portions and depressions, such as rings, with irregular raised portions and depressions, or with other non-planar interface (NPI) configurations.

Figure 5:
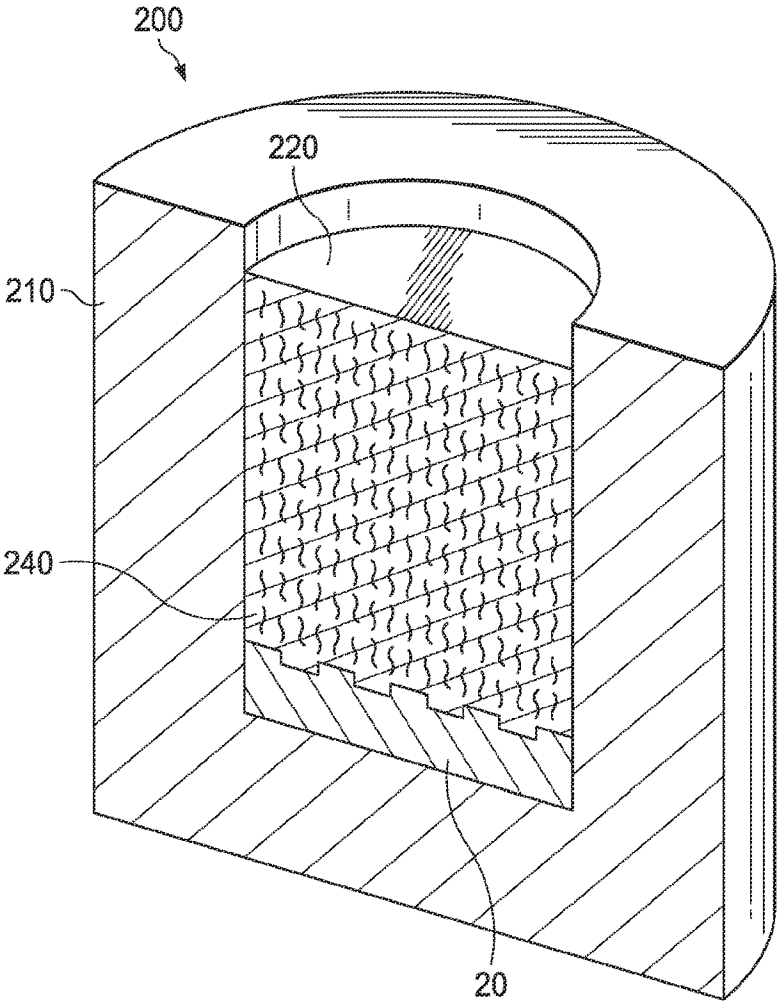
FIG. 5 is a not-to-scale cross-sectional schematic side view of another assembly for forming a PDC with a fiber-reinforced substrate.
Figure 4:
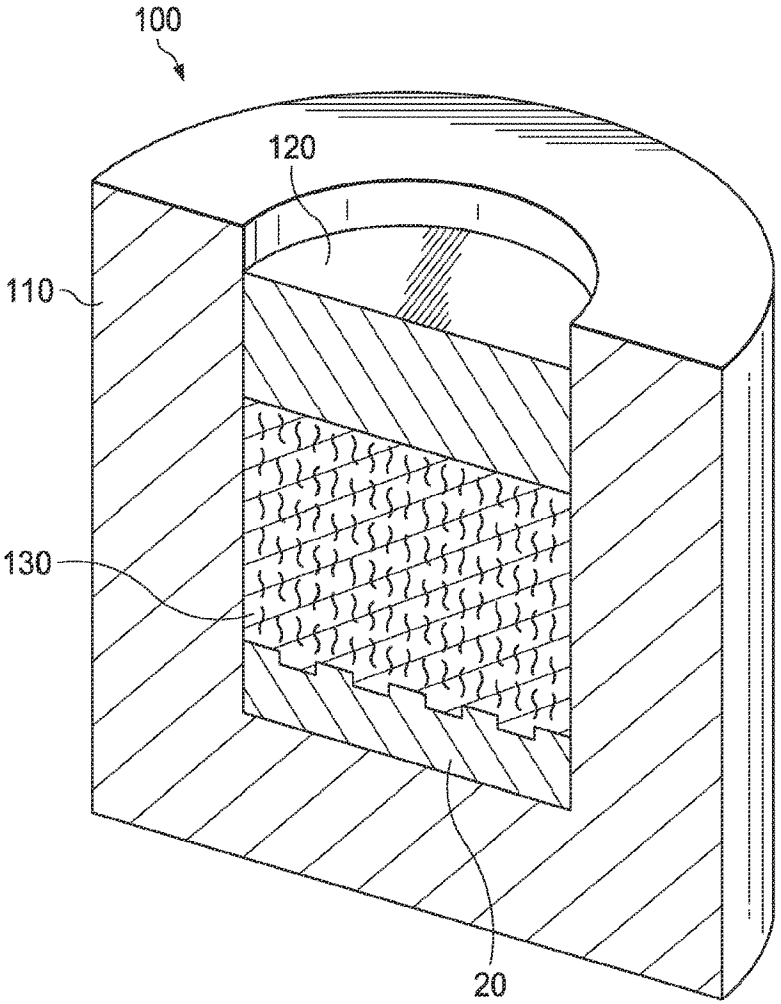
FIG. 4 is a not-to-scale cross-sectional schematic side view of an assembly for forming a PDC with a fiber-reinforced substrate.

The disclosure further includes an assembly 100 or 200 as shown in FIGS. 4 and 5 or for use with associated methods of manufacturing a PDC with a fiber-reinforced substrate, such as PDC 10. Assembly 100 or 200 includes a mold 110 or 210, used to shape PDC 10. Polycrystalline diamond table 20 is placed in mold 110 or 210. In an alternative, precursors of polycrystalline diamond table 20 may be placed in mold 110 or 210. Next the substrate precursors are placed in mold 110 or 210. The substrate precursors include fibers, binder, and cemented material precursors. The fibers and binder are as described above. The cemented material precursors are merely the cemented materials described above in powder form because they have not yet formed a solid material.

The fibers are disposed with the cemented material precursor typically in a manner that mimics their final distribution in substrate 30. Pre-mixing or filling of the cemented material precursor or the method of its deposit in mold 110 or 210 allows positioning of the fibers. For instance, if fibers are to be uniformly distributed in substrate 30, they may be pre-mixed with the cemented material precursor so that they are evenly distributed in that material when it is placed in mold 110 or 210. Cemented material precursor with or without fibers may be placed in different areas of mold 10 to form different areas of substrate 30, some with and some without fibers.

The orientation of ferromagnetic fibers may be altered during or after filling of the mold or possibly even during heating or cooling by applying a magnetic field to assembly 100 or 200 to cause the fibers to orient themselves in a particular direction in response to the magnetic field. For instance, the magnetic field may be applied to cause the longer dimension of the fibers to be generally at least a 70 degree angle to or perpendicular to polycrystalline diamond table 20 in the final PDC 10, such as is shown in FIG. 1.

Fibers may also be pre-assembled on polycrystalline diamond table 20, for instance by chemical attachment. The mold 110 or 210 may then be filled with the substrate precursor.

FIG. 4 illustrates a mold assembly in which the cemented material precursor 130 does not contain binder, or does not contain all of the binder. Instead, all or at least a portion of the binder is located above the cemented material precursor as binder 120. When assembly 110 is heated, binder 120 flows into cemented material precursor 130 to form substrate 30, as in a typical infiltration process used in powder metallurgy.

FIG. 5 illustrates a mold assembly in which the cemented material precursor 220 also contains the binder. When assembly 210 is heated, the binder melts and interacts with the cemented material precursor to form substrate 30.

In either embodiment, the binder may also infiltrate pores of polycrystalline diamond table 20, or assist in sintering of and form part of any precursors of polycrystalline diamond table 20.

In another embodiment (not depicted) a substrate 30 already containing fibers may simply be placed adjacent polycrystalline diamond table 20 then sintered or otherwise attached.

Assembly 100 or 200 may be heated in a furnace under air, nitrogen, or argon, or in a vacuum, in a hot press, or in any other suitable device. Assembly 100 or 200 may be heated to at least the melting point of all binders, but less than the melting point of all fibers. Assembly 100 or 200 may be cooled by removing if from the heating device, or it may be actively cooled or cooled in a controlled manner, such as in a cooling oven.

Figure 6:
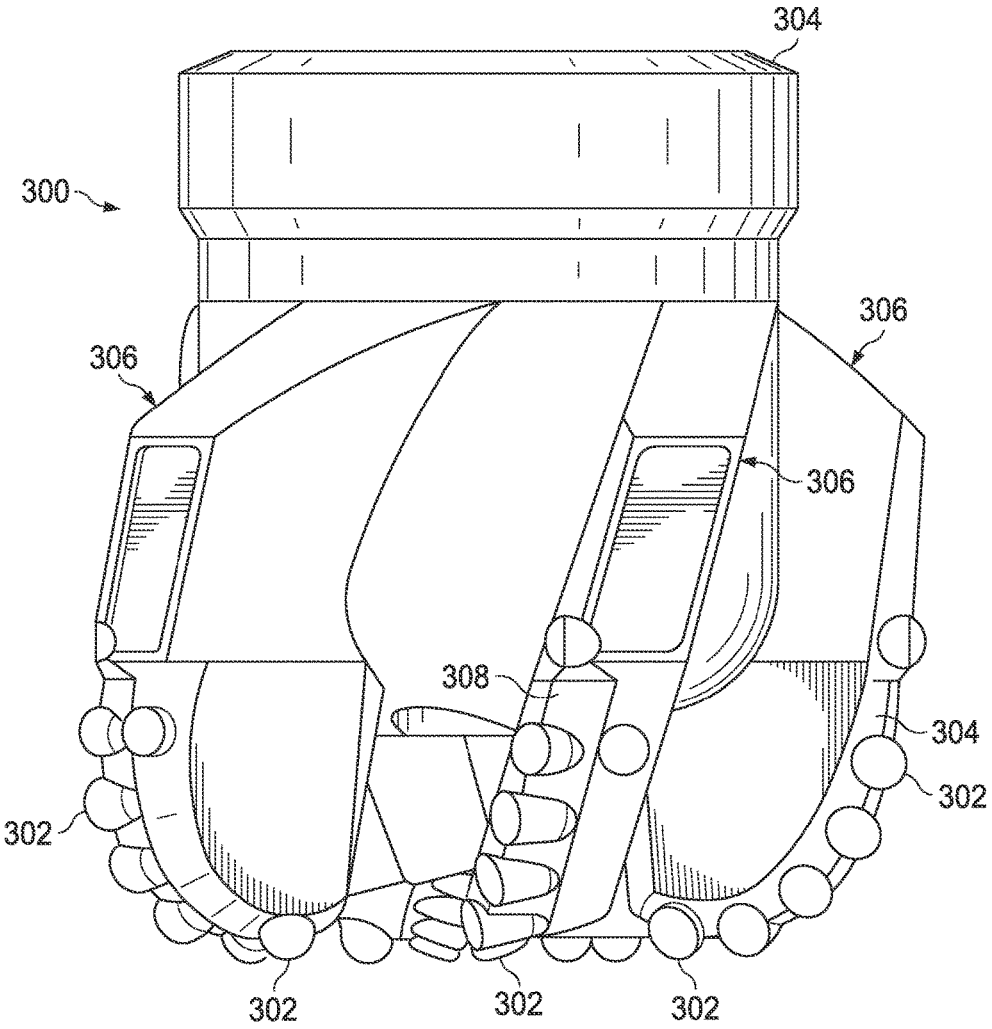
FIG. 6 is a is an earth-boring drill bit including at least one PDC in the form of a PDC cutter.

A PDC as described herein may be incorporated into an industrial device, such as an earth-boring drill bit, as illustrated in FIG. 6. FIG. 6 illustrates a fixed cutter drill bit 300 containing a plurality of cutters 302 coupled to drill bit body 304. At least one of cutters 302 may be a PDC containing a fiber-reinforced substrate as described herein, such as PDC 10 described in FIG. 1. Fixed cutter drill bit 300 may include bit body 304 with a plurality of blades 306 extending therefrom. Bit body 304 may be formed from steel, a steel alloy, a matrix material, or other suitable bit body material desired strength, toughness and machinability. Bit body 304 may be formed to have desired wear and erosion properties. PDC cutters 302 may be mounted on the bit using methods of this disclosure or using other methods. PDC cutters may be located in gage region 308, or in a non-gage region, or both. For the embodiment shown in FIG. 6, fixed cutter drill bit 300 has five (5) blades 306. For some applications the number of blades disposed on a fixed cutter drill bit incorporating teachings of the present disclosure may vary between four (4) and eight (8) blades or more. Drilling action associated with drill bit 300 may occur as bit body 304 is rotated relative to the bottom (not expressly shown) of a wellbore in response to rotation of an associated drill string (not expressly shown). At least some PDC cutters 302 disposed on associated blades 306 may contact adjacent portions of a downhole formation (not expressly shown) drilling. These PDC cutters 302 may be oriented such that the TSP table contacts the formation.

The present disclosure provides an embodiment (A) relating to a polycrystalline diamond compact (PDC) including a polycrystalline diamond table and a substrate. The substrate includes a cemented material, a binder, and a plurality of fibers having an average aspect ratio of at least a critical aspect ratio, $A_c$, wherein $A_c=\sigma_f/(2T_c)$, wherein $\sigma_f$ is ultimate tensile strength of the fibers and $T_c$ is shear bond strength between the fiber and the binder.

The present disclosure also provides an embodiment (B) relating to an earth-boring drill bit containing the PDC of embodiment A.

The present disclosure also provides an embodiment (C) relating to a method of forming a polycrystalline diamond compact (PDC) including forming an assembly including a mold, a polycrystalline diamond table or polycrystalline diamond table precursor in the mold, and a substrate precursor in the mold. The substrate precursor includes a cemented material, a binder having a highest melting point, and a plurality of fibers having a lowest melting point having an average aspect ratio of at least a critical aspect ratio, $A_c$, wherein $A_c=\sigma_f/(2T_c)$, wherein $\sigma_f$ is ultimate tensile strength of the fibers and $T_c$ is shear bond strength between the fiber and the binder. The method also includes heating the assembly to a temperature higher than the highest melting point of the binder and lower than the lowest melting point of the plurality of fibers.

In addition, embodiments A, B and C may be used in conjunction with the following additional elements, which may also be combined with one another unless clearly mutually exclusive, and which method elements may be used to obtain devices and which device elements may result from methods: i) at least a portion of the plurality of fibers may be bonded to the polycrystalline diamond table; ii) the plurality of fibers may be present in an area of the substrate and not present in another area of the substrate; iii) the plurality of fibers may be uniformly distributed in the substrate; the plurality of fibers may decrease in concentration with distance from the polycrystalline diamond table; iv) the plurality of fibers may be oriented so that their longer dimension on average is at a 70 degree angle with respect to an interface between the polycrystalline diamond table and the substrate; v) the plurality of fibers may include fibers including tungsten (W) molybdenum (Mo), titanium (Ti), chromium (Cr), manganese (Mn), yttrium (Yt), zirconium (Zr), niobium (Nb), Hafnium (Hf), Tantalum (Ta), nickel (Ni), carbon (C), any refractory ceramic, or any combinations, mixtures, or alloys thereof; vi) the fibers may be distinguishable from the cemented material and binder in the substrate; vii) the assembly may include a polycrystalline diamond table precursor and heating may further include heating the assembly to a temperature above a temperature at which the polycrystalline diamond table precursor forms a polycrystalline diamond table; viii) at least a portion of the plurality of fibers may be ferromagnetic, and a magnetic field may be applied to the assembly to orient the ferromagnetic portion of the plurality of fibers; ix) a method may further include bonding the fibers to the polycrystalline diamond table.

Although only exemplary embodiments of the invention are specifically described above, it will be appreciated that modifications and variations of these examples are possible without departing from the spirit and intended scope of the invention. For instance, the use of PDCs on other industrial devices may be determined by reference to the drill bit example.

The invention claimed is:

1. A polycrystalline diamond compact (PDC) comprising:
a polycrystalline diamond table; and
a substrate comprising:
a cemented material;
a binder; and
a plurality of fibers having an average aspect ratio of at least a critical aspect ratio, $A_c$, wherein $A_c=\sigma_f/(2T_c)$, wherein $\sigma_f$ is ultimate tensile strength of the fibers and $T_c$ is shear bond strength between the fiber and the binder.

2. The PDC of claim 1, wherein at least a portion of the plurality of fibers are bonded to the polycrystalline diamond table.

3. The PDC of claim 1, wherein the plurality of fibers are present in an area of the substrate and not present in another area of the substrate.

4. The PDC of claim 1, wherein the plurality of fibers are uniformly distributed in the substrate.

5. The PDC of claim 1, wherein the plurality of fibers decrease in concentration with distance from the polycrystalline diamond table.

6. The PDC of claim 1, wherein the plurality of fibers are oriented so that their longer dimension on average is at a 70 degree angle with respect to an interface between the polycrystalline diamond table and the substrate.

7. The PDC of claim 1, wherein the plurality of fibers includes fibers comprising tungsten (W) molybdenum (Mo), titanium (Ti), chromium (Cr), manganese (Mn), yttrium (Yt), zirconium (Zr), niobium (Nb), Hafnium (Hf), Tantalum (Ta), nickel (Ni), carbon (C), any refractory ceramic, or any combinations, mixtures, or alloys thereof.

8. The PDC of claim 1, wherein the fibers are distinguishable from the cemented material and binder in the substrate.

9. An earth-boring drill bit comprising:
a bit body; and
a polycrystalline diamond compact (PDC) comprising:
a polycrystalline diamond table; and
a substrate comprising:
a cemented material;
a binder; and
a plurality of fibers having an average aspect ratio of at least a critical aspect ratio, $A_c$, wherein $A_c=\sigma_f/(2T_c)$, wherein $\sigma_f$ is ultimate tensile strength of the fibers and $T_c$ is shear bond strength between the fiber and the binder.

10. The earth-boring drill bit of claim 9, wherein at least a portion of the plurality of fibers are bonded to the polycrystalline diamond table.

11. The earth-boring drill bit of claim 9, wherein the plurality of fibers are present in an area of the substrate and not present in another area of the substrate.

12. The earth-boring drill bit of claim 9, wherein the plurality of fibers are uniformly distributed in the substrate.

13. The earth-boring drill bit of claim 9, wherein the plurality of fibers decrease in concentration with distance from the polycrystalline diamond table.

14. The earth-boring drill bit of claim 9, wherein the plurality of fibers are oriented so that their longer dimension on average is at a 70 degree angle with respect to an interface between the polycrystalline diamond table and the substrate.

15. The earth-boring drill bit of claim 9, wherein the plurality of fibers includes fibers comprising tungsten (W) molybdenum (Mo), titanium (Ti), chromium (Cr), manganese (Mn), yttrium (Yt), zirconium (Zr), niobium (Nb), Hafnium (Hf), Tantalum (Ta), nickel (Ni), carbon (C), any refractory ceramic, or any combinations, mixtures, or alloys thereof.

16. The PDC of claim 1, wherein the fibers are distinguishable from the cemented material and binder in the substrate.

17. A method of forming a polycrystalline diamond compact (PDC) comprising:
forming an assembly comprising:
a mold;
a polycrystalline diamond table or polycrystalline diamond table precursor in the mold; and
a substrate precursor in the mold, the substrate precursor comprising:
a cemented material;
a binder having a highest melting point; and
a plurality of fibers having a lowest melting point having an average aspect ratio of at least a critical aspect ratio, $A_c$, wherein $A_c=\sigma_f/(2T_c)$, wherein $\sigma_f$ is ultimate tensile strength of the fibers and $T_c$ is shear bond strength between the fiber and the binder; and
heating the assembly to a temperature higher than the highest melting point of the binder and lower than the lowest melting point of the plurality of fibers.

18. The method of claim 17, wherein the assembly comprises a polycrystalline diamond table precursor and heating further comprises heating the assembly to a temperature above a temperature at which the polycrystalline diamond table precursor forms a polycrystalline diamond table.

19. The method of claim 17, wherein at least a portion of the plurality of fibers is ferromagnetic, further comprising applying a magnetic field to the assembly to orient the ferromagnetic portion of the plurality of fibers.

20. The method of claim 17, further comprising bonding the fibers to the polycrystalline diamond table.

* * * * *